United States Patent [19]

Tateishi

[11] Patent Number: 4,972,570

[45] Date of Patent: Nov. 27, 1990

[54] METHOD OF MANUFACTURING AN OSCILLATING FAN

[76] Inventor: Art K. Tateishi, 25 Warrender Avenue, Apt. #202, Toronto, Ontario, Canada M9B 5Z4

[21] Appl. No.: 358,243

[22] Filed: May 30, 1989

[51] Int. Cl.[5] ..... B23P 11/02

[52] U.S. Cl. ..... 29/453; 29/469

[58] Field of Search ..... 29/156 BCF, 436, 453, 29/469, DIG. 13, 889.3; 219/366, 368, 369, 370, 371; 415/60, 61, 201, 214.1, 122.1

[56] References Cited

U.S. PATENT DOCUMENTS

| | | | |
|---|---|---|---|
| 2,768,782 | 10/1956 | Tateishi | 417/361 |
| 2,836,350 | 5/1958 | Tateishi | 415/125 |
| 2,875,316 | 2/1959 | Ford et al. | 219/371 X |
| 3,775,590 | 11/1973 | Gartner | 219/371 X |
| 3,902,045 | 8/1975 | Laing | 219/371 |
| 4,437,394 | 3/1984 | Tateishi | 98/40.3 |
| 4,737,616 | 4/1988 | Wen-Yung | 219/370 |
| 4,739,153 | 4/1988 | Rendel et al. | 219/370 X |
| 4,743,737 | 5/1988 | Tateishi | 219/368 |
| 4,743,739 | 5/1988 | Tateishi | 219/368 |

FOREIGN PATENT DOCUMENTS

| | | |
|---|---|---|
| 1130251 | 8/1982 | Canada . |
| 1169828 | 6/1984 | Canada . |
| 1251820 | 3/1989 | Canada . |

*Primary Examiner*—Timothy V. Eley
*Assistant Examiner*—Frances Chin

[57] ABSTRACT

The present invention provides a method of assembling a fan where the fan itself comprises a plurality of fan components and a housing portion having an open end with an interior area defined by component receiving regions. The method includes positioning the housing portion with its open end up and then locating the components in set positions in the housing portion with those set positions being initially maintained by cooperative fitting of the components in the component receiving regions. After the components have been located in their set positions, the fan is then secured by mechanical locking means to releasably secure the components in the housing portion.

1 Claim, 6 Drawing Sheets

METHOD OF MANUFACTURING AN OSCILLATING FAN

FIELD OF THE INVENTION

The present invention relates to a method of assembling a fan having a housing portion with component receiving regions and a plurality of modular components that are essentially self fitting in those component receiving regions for initial assembly of the fan, the final construction of which is secured by screws or bolts. Only a very few screws or bolts are required because of the self fitting aspect of the components prior to final assembly.

BACKGROUND OF THE INVENTION

Most up to date electric fans include a large number of small components which are generally awkward and time consuming to fit in the fan. Added to this is the fact that some fan constructions have now gone to a combination heater and fan further increasing the number of components in the construction.

In most fan assemblies, the many components each require their own set screw or the like to hold that particular component in position while the rest of the fan is being assembled. This adds further to the cost of the fan whether it be a conventional or a heater fan from both a labour standpoint and a material standpoint because of the costs of the set screws themselves.

SUMMARY OF THE PRESENT INVENTION

The present invention provides a method of assembling a fan where the fan itself comprises a housing portion and a plurality of fan components to be fitted into the housing portion. The housing portion has an open end and an interior area defined by component receiving regions. According to the method of the present invention the housing portion is positioned open end up and the components are located or laid in set positions by a cooperative fit between the components and the component receiving regions. It is only after the components have been established in their set positions that mechanical locking means are then provided to releasably secure the component within the housing portion.

According to a preferred embodiment of the present invention the fan includes a pair of housing portions both of which are independently assembled and which are thereafter secured to one another by releasable securing means such as nuts or bolts.

The method of constructing a fan according to the present invention eliminates the need for securing means such as set screws or the like at each and every stage in the construction. Very little labour is required and the cost of materials for the construction is substantially reduced from conventional material costs.

BRIEF DESCRIPTION OF THE DRAWINGS

The above as well as other advantages and features of the present invention will be described in greater detail according to the preferred embodiments of the present invention in which.

Figure 1:
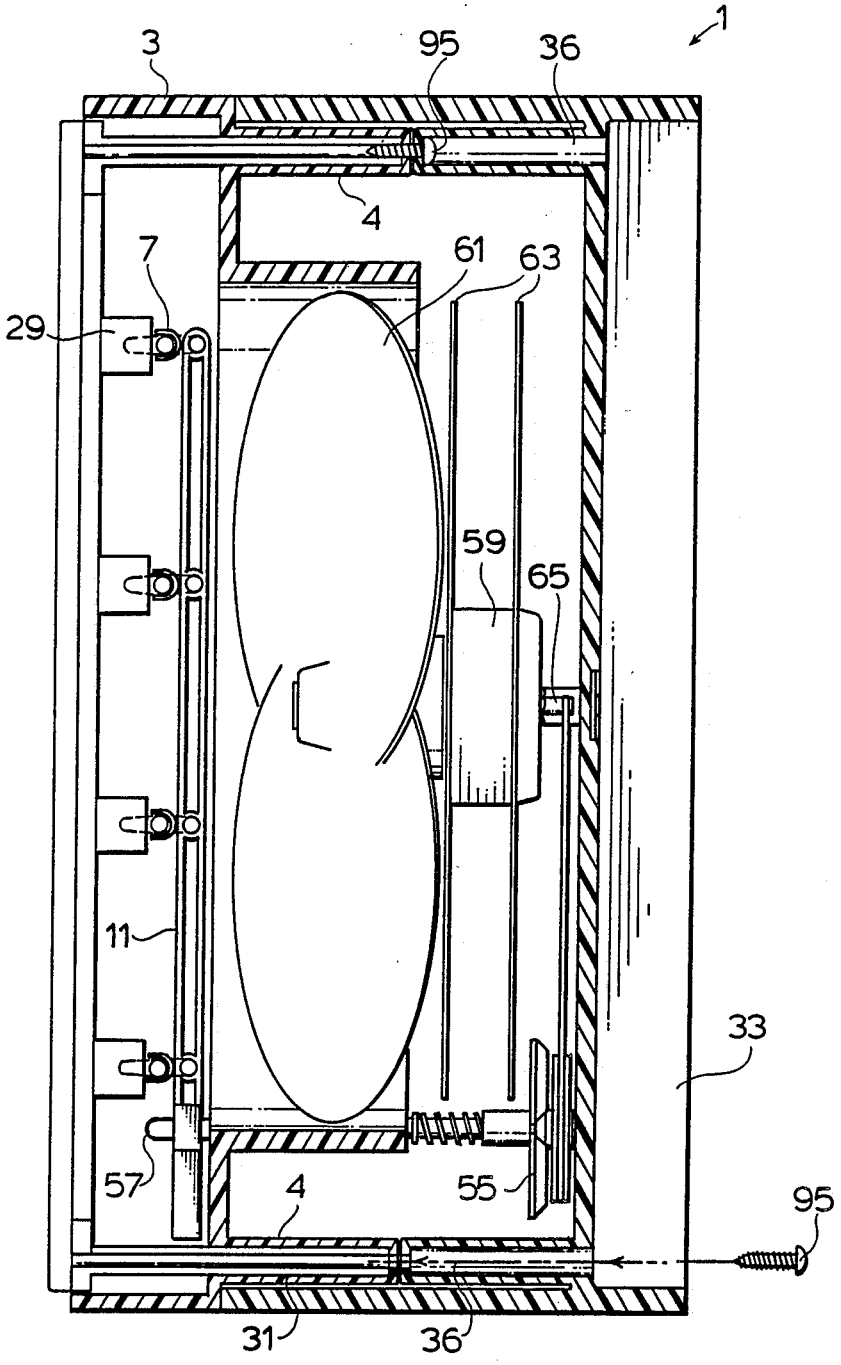
FIG. 1 is a sectional view looking down through a fan and in particular a heater fan according to a preferred embodiment of the present invention.

DETAILED DESCRIPTION ACCORDING TO THE PREFERRED EMBODIMENTS OF THE PRESENT INVENTION:

FIG. 1 shows in section a fan and in particular a heater fan generally indicated at 1. This heater fan is formed from two separate housing portions which are independently fitted or assembled with fan components and which are then secured to one another. More particularly, the fan includes a forward housing portion 3 and a rearward housing portion 33.

Figure 2:
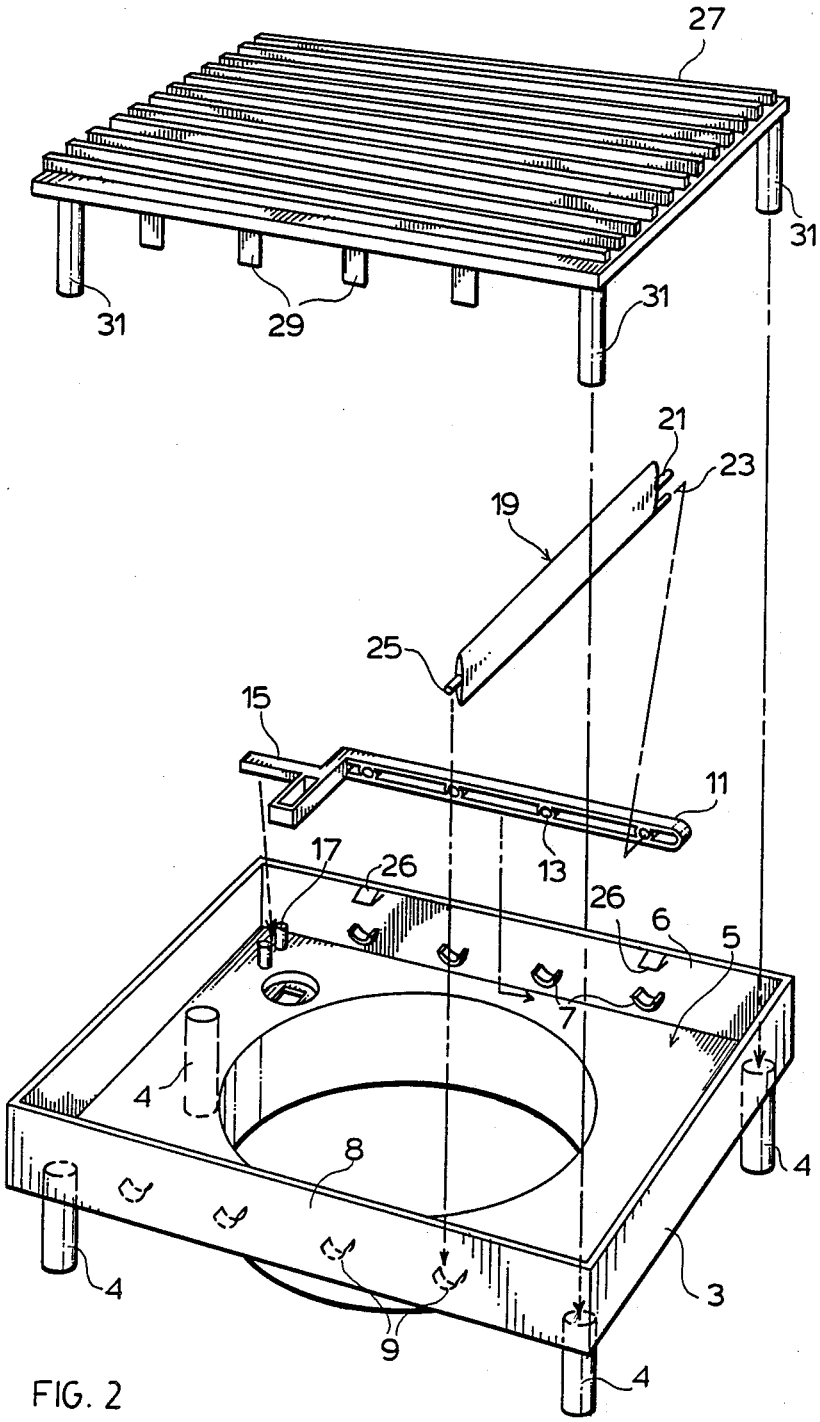
FIG. 2 is an exploded perspective view of the forward housing portion of the fan of Fig. 1.

The assembly of the forward hOusing portion is best seen having reference to FIG. 2 of the drawings. It is to be noted that one of the keys in assembling this housing portion relates to how the Components are simply laid into preset positions which are maintained simply by weight of the components until final assembly of the front housing portion.

Housing portion 3 is defined by an interior area 5 having a plurality of component receiving regions. As will be seen in FIG. 2, the forward housing portion for its assembly is placed open end up to locate the components in these component receiving regions.

Provided along the interior of the top wall 6 of the forward housing portion are a plurality of semi-circular collar pieces 7. Similar collar pieces 9 are provided along the lower wall 8 of the forward housing portion.

The forward housing portion is specifically designed to receive a plurality of oscillating louvers such as louver 19. A louver bar 11 is used to provide oscillation of the louvers. This louver bar fits immediately beneath collar portions 7 and with operation of the fan slides from side to side within the forward housing portion. The louver bar includes a guide portion 15 which fits between a pair of upstanding lugs 17 to maintain positioning of the louver bar as it slides within the forward housing portion.

Each of the louvers 19 is provided at its upper end with a pair of circular pins 21 and 23. Pins 21 seat within the collar portions 7 while pins 23 are located within circular openings 13 provided within the louver bar. The lower ends of the louvers are provided with pins 25 which seat within the collar portions 9 on the bottom wall of the forward housing portion.

It will be appreciated from the above how the louver is simply dropped down into the collar portions to provide a preset positioning of the louvers while the louver bar itself is in a preset position for receiving pins 23 to provide oscillation of the louvers with the movement of the louver bar. Note that none of the above assembly has required anything in the way of a retaining screw or the like to hold the components in position.

After all of the louvers, only one of which is shown in FIG. 2, have been properly located in position housing portion 3 is fitted with a forward grill 27. This forward grill includes a plurality of legs 29 to both the upper and lower ends of the grill. In FIG. 2 only those legs at the bottom end of the drill can be seen.

The drill further includes additional securing legs 31. These legs are positioned to line up with four leg receiving rearward extensions 4 provided on the actual housing portion itself.

When the grill cover is pushed down onto the housing portion, legs 29 trap pins 21 and 25 in the respective collars 7 and 9 on the inner surfaces of the upper and lower walls 6 and 8 of housing portion 3. Legs 31 frictionally engage within the rearward extensions 4 of the housing portion. This provides a tight interlock between the grill and the forward housing portion. This interlock is further secured by a pair locks 26 provided along the upper wall 6 of the forward housing which when the grill is in its fully secured position look along the top edge of the grill. These locks have a cammed outer surface over which the grill edge snaps when fitting the grill in the housing portion.

When assembled as described above, forward housing portion is now ready to be fitted directly to the rearward housing portion which is assembled independently of the forward housing portion.

The assembly of the rearward housing portion is seen having reference to FIGS. 4 through 8 of the drawings. This housing portion includes an interior area generally indicated a 35. A number of component fitting regions are provided within this interior area. These components fitting regions include a small spindle or post 37 supported by the rear grill 38 of the housing, a pair of collars 39 through the housing and a small tit 41 again supported by the grill. Tit 41 is lined up across the grill from pin 37 to the otherside of and between collars 39.

Also provided in the back housing portion is a rounded opening 45, a cam rise 46 and an elongated slightly arcuate opening 47.

A plurality of fan components are once again designed to fit into the rear housing portion which is placed open end up to receive these components. The components are fitted or placed in position in sequence as follows.

Figure 4:
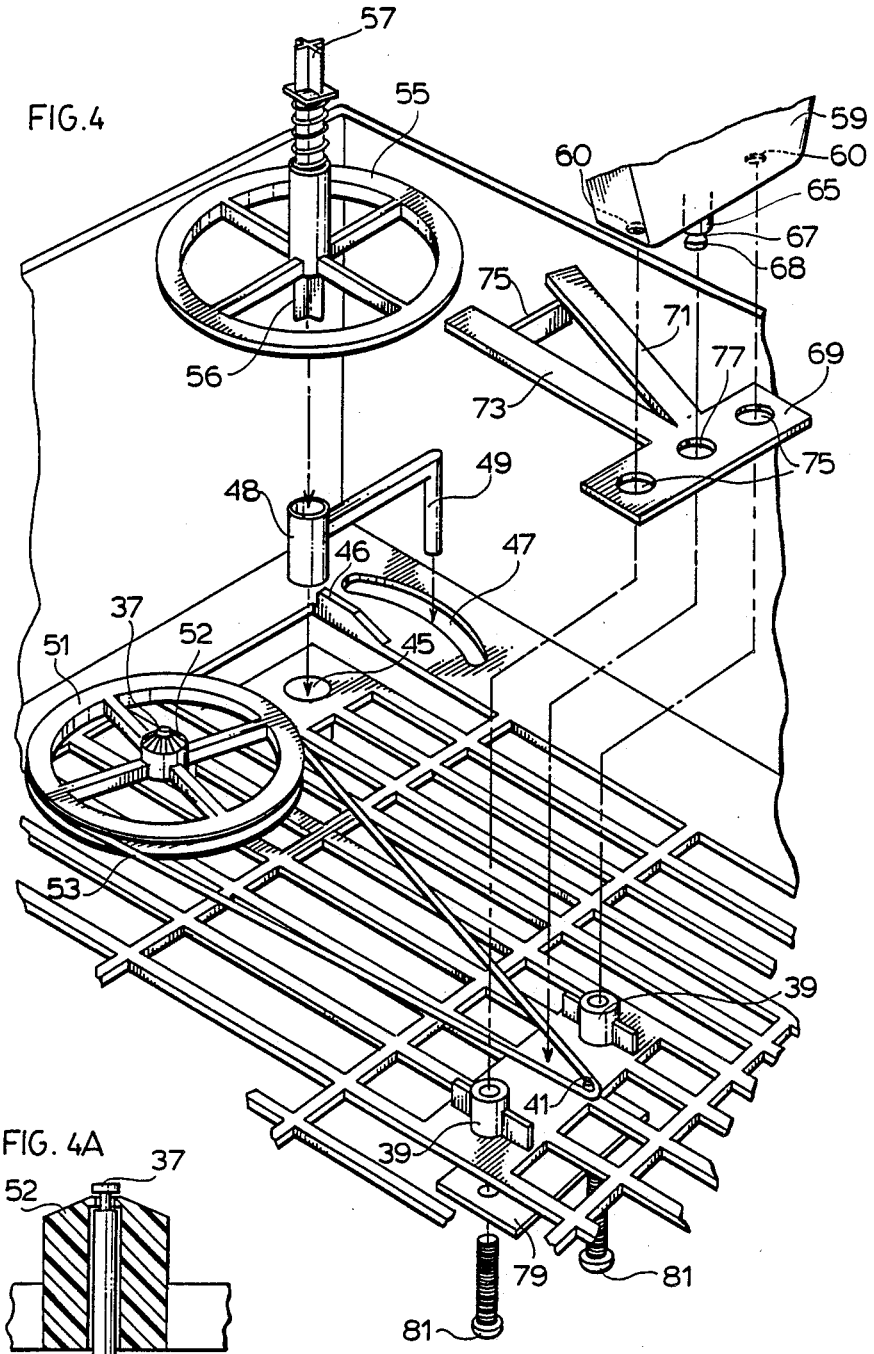
FIG. 4 is a further enlarged exploded perspective view of the interior region of the housing portion of FIG. 3.
Figure 4A:
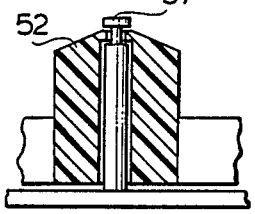
FIG. 4A is an enlarged sectional view of the mounting of a gear component of the interior region shown in FIG. 3.

A gear wheel 51 having a center hub 52 is snapped down over pin 37. FIG. 4A shows that hub 52 has a center pin receiving opening with an interference or inwardly projecting upper end region defining an undercut shape in the opening. Pin 37 has an upper end groove whereby when the hub is pushed fully down onto the pin, the interference region snaps into the groove on the pin locking gear wheel 52 in position. A rubber drive belt 53 is then fitted around gear wheel 51 and stretched onto tit 41. A gear connector 48 is dropped down into opening 45 with the rearward extension or arm 49 of the gear connector fitting through elongated opening 47. A second gear 55 having a forward shaft portion 56 is fitted into connector 48. A second shaft portion 57 then fits into gear 55 and extends to the front louver bar as shown in FIG. 1 of the drawings.

FIG. 1 also shows a fan motor 59 which drives a fan blade 61. The fan motor additionally energizes a pair of heating elements 63 which can be turned on and off while the fan motor is operating, i.e. the fan can be used strictly in a fan mode or in a fan heater mode.

Provided to the rear of the fan motor is an output or drive shaft 65 which has a recessed region 67 bordered by an enlarged end region 68 on the shaft.

The fan motor with the heating elements fitted therearound is placed in the rear housing portion over the two collars 39. Positioned intermediate the collars and the fan motor is a drive belt guard 69 having a pair of arms 71 and 73 with a small cross piece 75 between the arms and which snaps down into the grill to hold proper position of guard 69. The drive belt guard further includes a pair of outer side openings 75 and a center opening 77.

Again, it is to be noted that all of the components as described above are simply laid or in the case of gear wheel 51 and drive belt 53 pushed down into position at the back of the rear housing portion without requiring the use of any securing screws or the like. It is only with the fitting of fan 59 that screw assembly is required and as noted above, fan 59 is the last component fitted into the rear housing portion. The back of the fan is provided with small threaded openings 60 which line up with openings 75 of the drive belt guard positioned over collars 39. Motor shaft 65 then fits down through the center opening 77 of the drive belt guard. In this position, a pair of bolts 81 are fitted from the back of the housing through both collars 39 and drive belt guard 69 to thread into the openings 60 on motor 59 to secure the components as described above in position.

Figure 5:
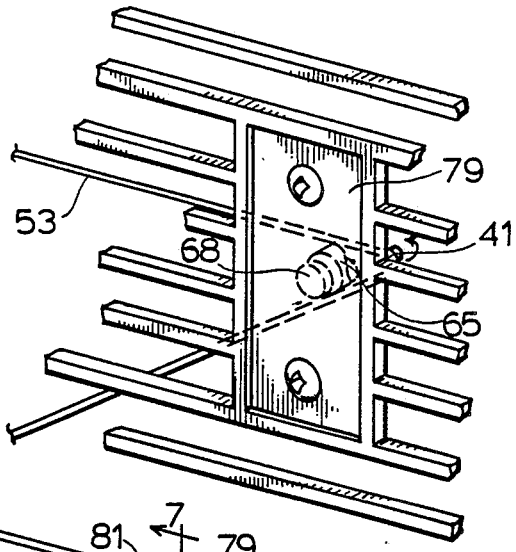
FIG. 5 is an enlarged perspective view showing a step in the assembly from the rear surface of the housing portion of FIG. 4.
Figure 6:
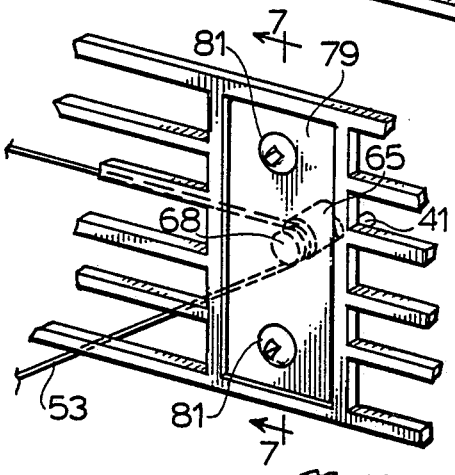
FIG. 6 is a view similar to FIG. 5 with the exception that it shows one further stage in the assembly of the fan.
Figure 7:
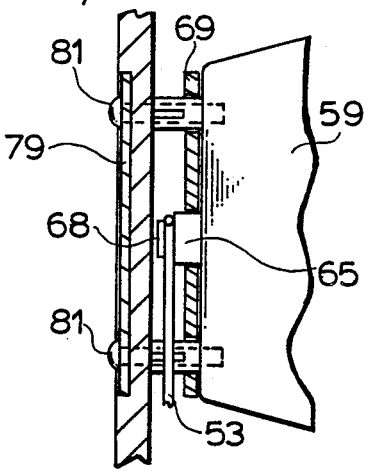
FIG. 7 is a side view of the arrangement shown in FIG. 6.

Both the forward and the rearward housing portions are preferably made from a plastic material and in order to reinforce support for the fan motor a small metal plate 79 is fitted to the rear outside of the back housing portion. This plate is best shown in FIGS. 5 and 6 of the drawings.

In keeping with the present invention, it is important that the fitting of the stretched drive belt 53 from gear 51 to motor shaft 65 be done in a non-time consuming manner. However, as will be appreciated from the description above, since gear 51 and fan motor 59 are fitted into the housing portion in separate stages and the drive belt is to the back of or behind both components, the fitting of the drive belt could well be awkward. This problem is answered by the pre-stretching of the belt over tit 41 which as noted above is positioned centrally to the other side of collar 39 from gear pin 37. Therefore, when the fan motor is properly positioned within the housing portion its shaft 65 is automatically positioned inside of the stretched drive belt, as seen in FIG. 5 of the drawings. The drive belt where stretched over tit 41 is exposed through the grill and once the motor shaft is properly positioned, the drive belt is simply popped off of tit 41 where it then snaps into the recessed region 67 of shaft 65. This assembly step as noted above allows the insertion of the components in their properly sequenced order, i.e. gear wheel 51 then the drive belt, then the motor shaft while at the same time positioning the drive belt to be easily fitted onto from beneath the motor shaft.

Figure 3:
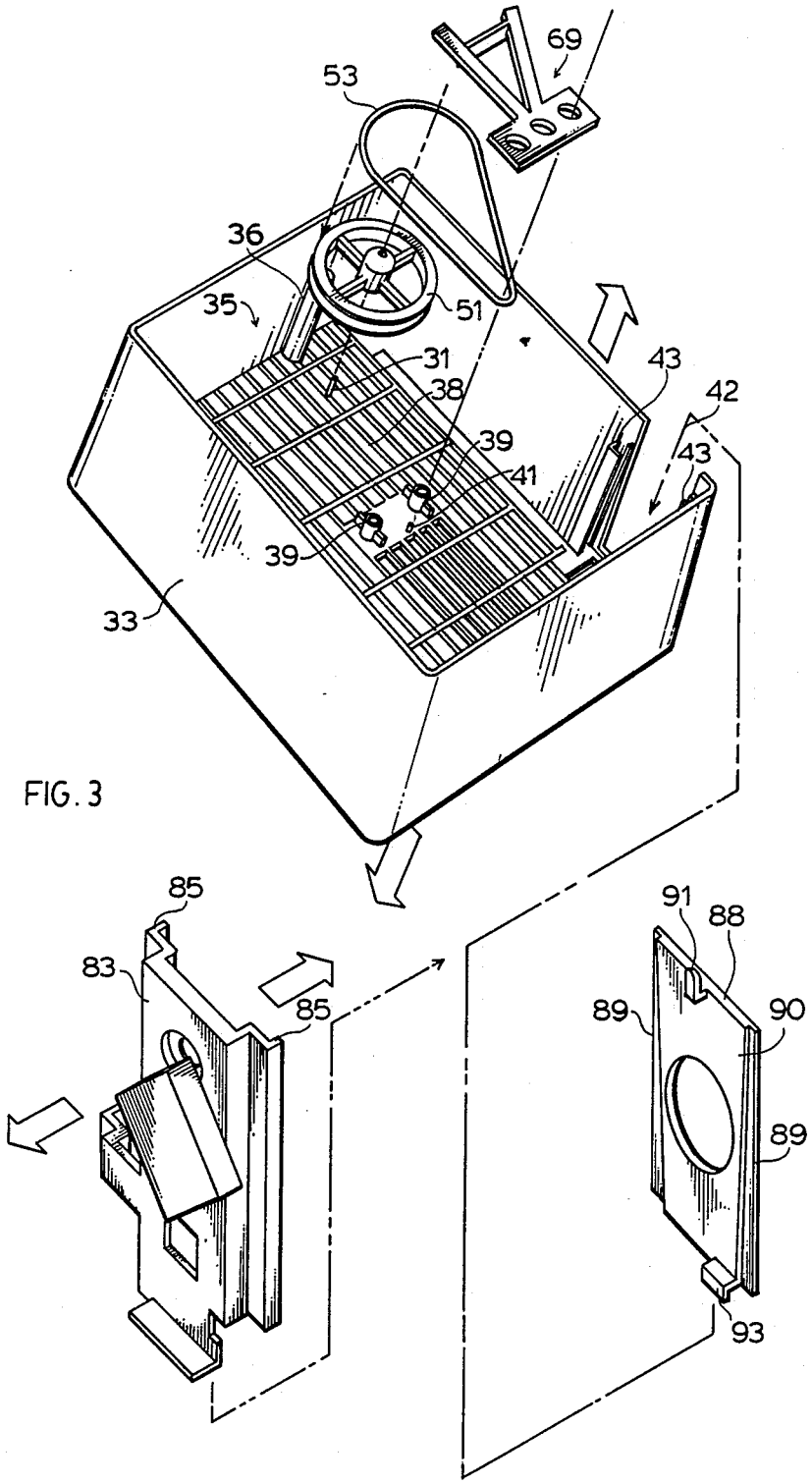
FIG. 3 is an exploded perspective view of the rear housing portion of the fan of FIG. 1.
Figure 8:
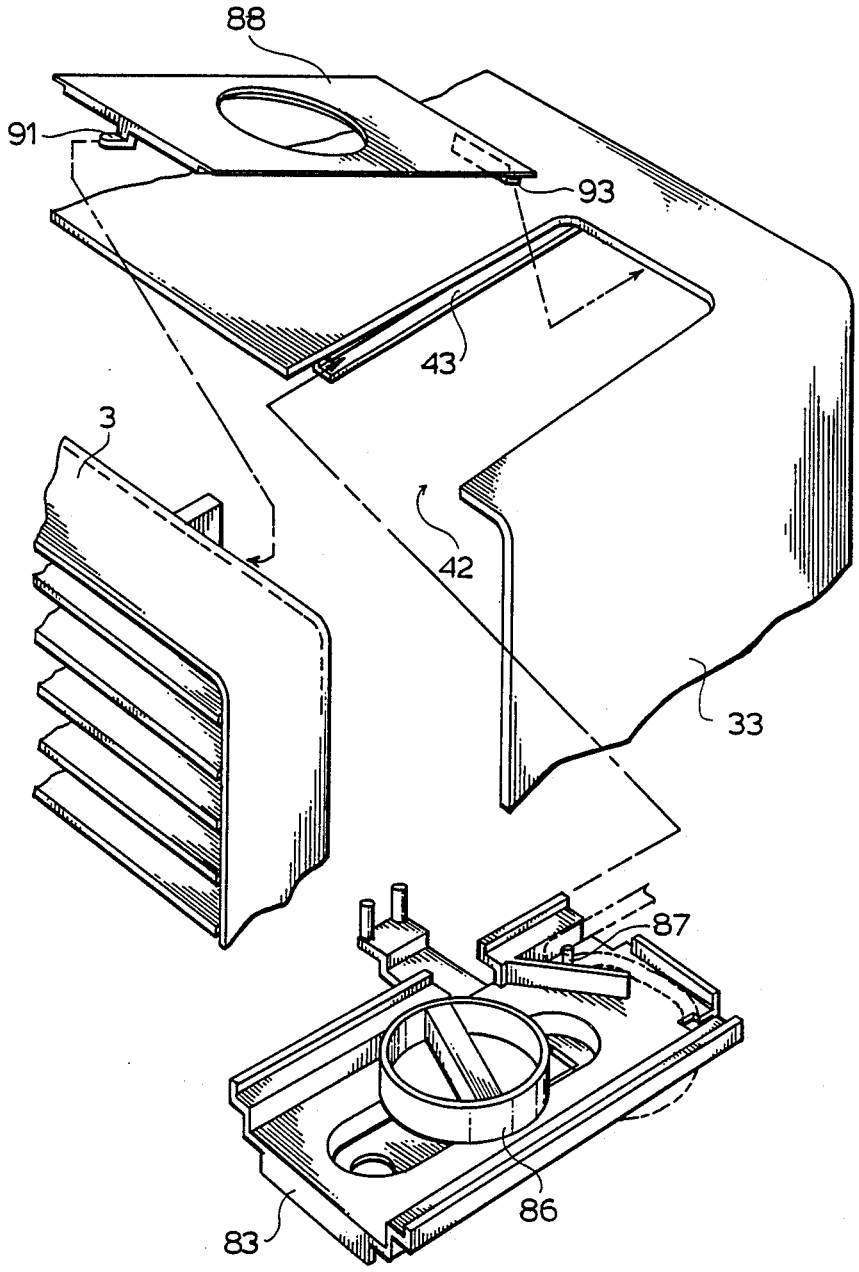
FIG. 8 is a further exploded perspective view of the assembly of the housing portion shown in FIG. 3 of the drawings.

FIGS. 3 and 8 show further assembly features of the rear housing portion which is provided to one side with an enlarged opening 42 defined to either side by a pair of runners 43. These runners are set to receive a control mount plate 83 having a pair of side arms 85 for slideably engaging side portions 89 of a cover 88 for plate 83. The plate slides down into the runners 43 once again with the rear housing portion sitting open end up.

Plate 83 includes a control nob 86 which is exposed through an opening 90 in the cover 88. The plate further includes a cord lock 87 for locking the electrical cord of the fan heater.

Cover 88 includes a lower tab 93 which seats against the rear housing portion as well as an upper tab 91 which locks with the forward housing portion when the two housing portions are fitted together during final assembly of the fan.

To this point, both housing portions have been assembled independently of one another with essentially no screwing or bolting other than than the bolts to mount the fan motor. Both housing portions have been assembled placed open side up and simply laying or pushing the components down into position.

The two housing portions are now ready with their parts hold in position for fitting to one another to complete the assembly as seen in FIG. 3 of the drawings. The rear housing portion includes four forwardly projecting bolt receiving extensions 36, which when the two housing portions are fitted with one another line up with the rearward extensions 4 on the forward housing portion. Note again that the grill extensions 31 are telescopically engaged in extensions 4. The arms or extensions 31 are internally threaded and with everything properly lined up as shown in FIG. 1 screws 95 are then fitted up into arms 36 and threadably engage extensions 31 trapped in arms 4 for a final securing of the fan assembly. It is to be noted as shown in FIG. 8 that the cover 88 for plate 83 is trapped by its tabs 91 and 93 between the forward housing portion 3 and the rearward housing portion 33.

Although various preferred embodiments of the invention have been described in detail, it will be appreciated by those skilled in the art that variations may be made without departing from the spirit of the invention or the scope of the appended claims.

The embodiments of the invention in which an exclusive property or privilege is claimed are defined as follows:

1. A method of assembling a fan construction comprising a housing portion having an open end and an interior area defined by component receiving regions and a plurality of fan components, said method comprising positioning said housing portion open end up and locating said components in set positions in said housing portion, said set positions being initially maintained by cooperative fitting of said components in said component receiving regions and thereafter by mechanical locking means to releasably secure said fan construction, said components including a fan motor having an output shaft and a gear member driven by said output shaft through a stretchable drive belt, said method including snap mounting said gear member to a pin in said housing portion through an interference and groove fitting between said gear member and said pin, stretching said drive belt around said gear member and over a tit in said housing, positioning said fan motor in said housing with said output shaft located between said gear member and said tit surrounded by said drive belt and releasing said drive belt from said tit to snap onto said output shaft of said fan motor.

* * * * *